US006438247B1

(12) United States Patent
Cipolla et al.

(10) Patent No.: US 6,438,247 B1
(45) Date of Patent: Aug. 20, 2002

(54) SEATBELT MICROPHONE MOUNTING

(75) Inventors: Thomas Mario Cipolla; Ponani Gopalakrishnan, both of Westchester County, NY (US); Stephane Herman Maes, Danbury, CT (US); Paul Andrew Moskowitz, Westchester County, NY (US); Jan Sedivy, Praha (CZ)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/239,328

(22) Filed: Jan. 28, 1999

(51) Int. Cl.[7] ..... H04R 25/00

(52) U.S. Cl. ..... 381/365; 379/446; 381/374; 381/385; 381/389; 297/464; 297/485; 297/468; 280/801.1

(58) Field of Search ..... 381/374, 385, 381/389, 365; 379/446, 455, 454, 420, 433, 442, 450; 455/90; 280/801.1; 297/464, 485, 181, 230.1, 488; 224/163; 24/31 R; 428/16

(56) References Cited

U.S. PATENT DOCUMENTS

| | | | | | |
|---|---|---|---|---|---|
| 4,040,547 | A | * | 8/1977 | Dickey | 224/5 H |
| 4,126,827 | A | | 11/1978 | Negaini | 325/16 |
| 4,146,191 | A | * | 3/1979 | Cavanaugh | |
| 4,811,405 | A | * | 3/1989 | Peiker | |
| 4,893,835 | A | * | 1/1990 | Linden | 280/808 |
| D310,082 | S | | 8/1990 | Kelly et al. | D14/227 |
| 4,953,809 | A | * | 9/1990 | Barrus | |
| 4,991,220 | A | * | 2/1991 | Wolf | 381/169 |
| 5,325,818 | A | * | 7/1994 | Leach | 119/770 |
| 5,602,928 | A | * | 2/1997 | Eriksson | 381/71 |
| 5,668,869 | A | * | 9/1997 | Zinno | |
| 5,938,137 | A | * | 8/1999 | Poulson | |
| 6,079,370 | A | * | 6/2000 | Al-birmani | 119/771 |
| 6,114,774 | A | * | 9/2000 | Fiegura | 307/9.1 |

* cited by examiner

*Primary Examiner*—Curtis Kuntz
*Assistant Examiner*—Dionne Harvey
(74) *Attorney, Agent, or Firm*—Stephen C. Kaufman

(57) ABSTRACT

A microphone bearing slider on a diagonal seatbelt member, together with a tethering tape that is positioned along the diagonal seatbelt, from a seatbelt hanger member to the buckle with attachment to the slider, in combination, operate to position the microphone at the same precise location for vocal transmission at each deployment, and to return the assembly to a storage position with no addition attention being required on the part of the communicating person.

15 Claims, 4 Drawing Sheets

FIG. 6
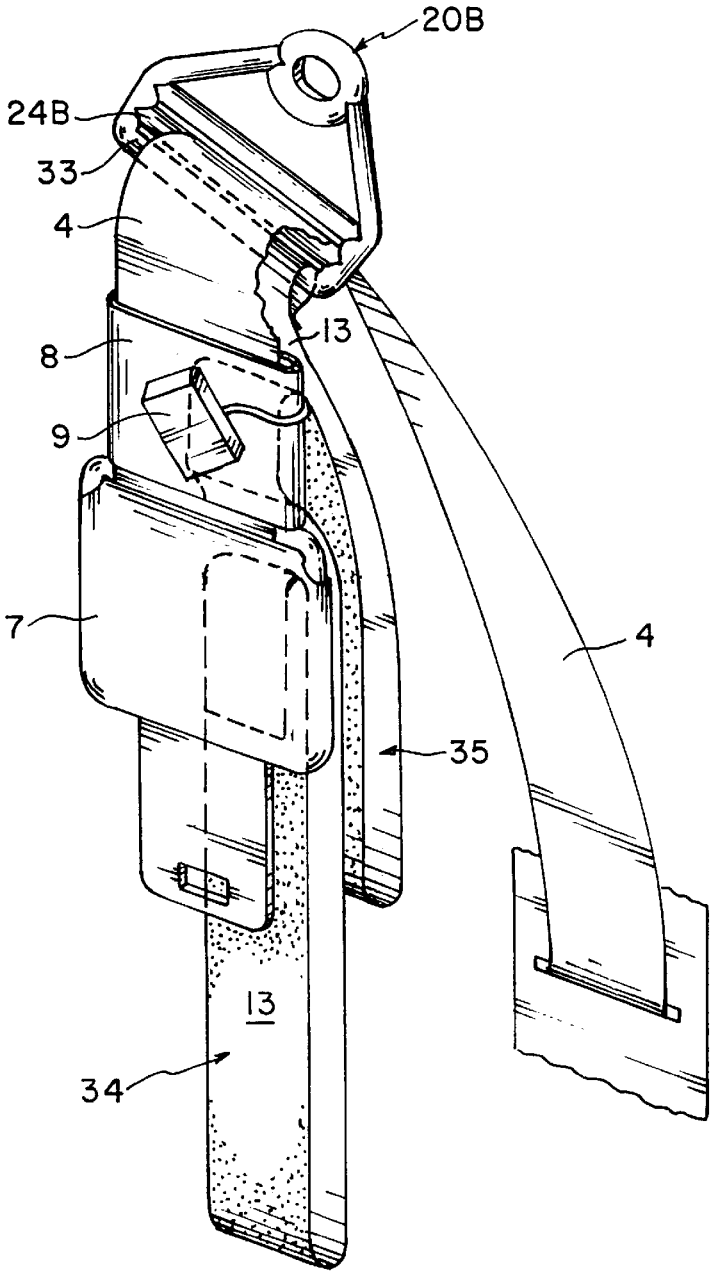
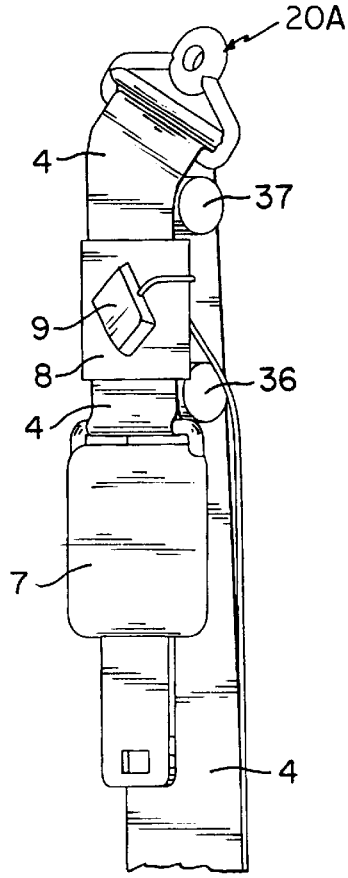
FIG. 7

SEATBELT MICROPHONE MOUNTING

FIELD OF THE INVENTION

The invention relates to microphone positioning in a vehicle for voice communication and in particular to the positioning, of a microphone for voice communication, on the diagonal shoulder strap of a seat belt.

BACKGROUND OF THE INVENTION AND RELATION TO THE PRIOR ART

In the development of the technology of providing a microphone through which a voice communication from a person is transferred to a processor, it has been found that advantages are gained where the microphone is positioned as close to the mouth of the communicating person as possible.

There has been some attention in the art related to the subject of microphone positioning. In U.S. Design Pat. Des. No. 310,082 an ornamental design is shown in which a microphone is positionable on a seatbelt. In U.S. Pat. No. 4,040,547 a large clip places a microphone where desired such as on an article of clothing or a belt. In U.S. Pat. No. 5,602,928 a communication system for a vehicle is shown wherein the error microphone is mounted on or in a seatbelt. In U.S. Pat. No. 4,126,827 an assembly is shown for mounting a microphone on the steering wheel of a vehicle; and in U.S. Pat. No. 4,991,220 a vibration dampening clip structure is shown for mounting a microphone.

Heretofore in the art no attention has been paid to the acoustic advantages in verbal communication gained in mounting a microphone on a diagonal seatbelt and that the microphone position be always the same and that there be no interference by the microphone with the use of the seatbelt.

A desirable situation would be to have the microphone mounted at the most beneficial location on the seatbelt for voice communication and to have the microphone mounting on the seatbelt be such that it did not interfere with the communicating person or that anything extra was required of the communicating person.

SUMMARY OF THE INVENTION

In the invention, a slider microphone holder is positioned on a diagonal seatbelt so that the microphone is located at the same place on the person wearing the seatbelt when the seatbelt is deployed after being retracted The invention operates to position the microphone at the same precise location for favorable vocal transmission at each deployment, and to return the assembly to a storage position with no additional attention being required on the part of the communicating person.

In an embodiment a tethering function is achieved using a tape that is narrower than the diagonal seat belt web, and attaching the tape to establish a specific dimension along the web when the web is deployed. The tethering strap is fastened on an extra cross bar on the seatbelt hanger. The slider has a face portion with two curved around portions that provide a slot that accommodates the diagonal seatbelt, and is positioned on the diagonal seatbelt. The slider has a microphone on the face thereof, pointed upward toward where the user's mouth would be.

The narrower tethering tape follows the underside of the diagonal seatbelt web to the buckle, is fastened to the back of the slider at a distance from the buckle that establishes the microphone location on the sternum of the person wearing the seatbelt, and continues to the seatbelt hanger.

BRIEF DESCRIPTION OF THE DRAWINGS

FIG. 6 is a schematic perspective illustration of the seatbelt microphone mounting of the invention illustrating the relationship of the parts at the retention hanger when the seatbelt is retracted.

FIG. 7 is a schematic perspective illustration of the seatbelt microphone mounting of the invention illustrating the relationship of the parts at the retention hanger when the tape and web are wound on torsional winders.

DESCRIPTION OF THE INVENTION

The invention involves modifications to an existing diagonal and lap combination type seatbelt arrangement. The invention automatically positions the microphone in the precise position for accurate speech transmission, through the cycle of deployment and then return to the storage position. The modifications include a combination of a slider on which the microphone is mounted, on the diagonal seatbelt member, a tethering tape or strap that runs from the hanger to the buckle along the diagonal seatbelt member, and which is attached to the slider at a distance from the buckle that positions the microphone at the sternum of the person wearing the seatbelt. There is an adaptation of the seatbelt hanger for attachment of the strap and for microphone wiring control. There is also an adaptation for torsional winding of the tape and diagonal web in the storage position.

Figure 1:
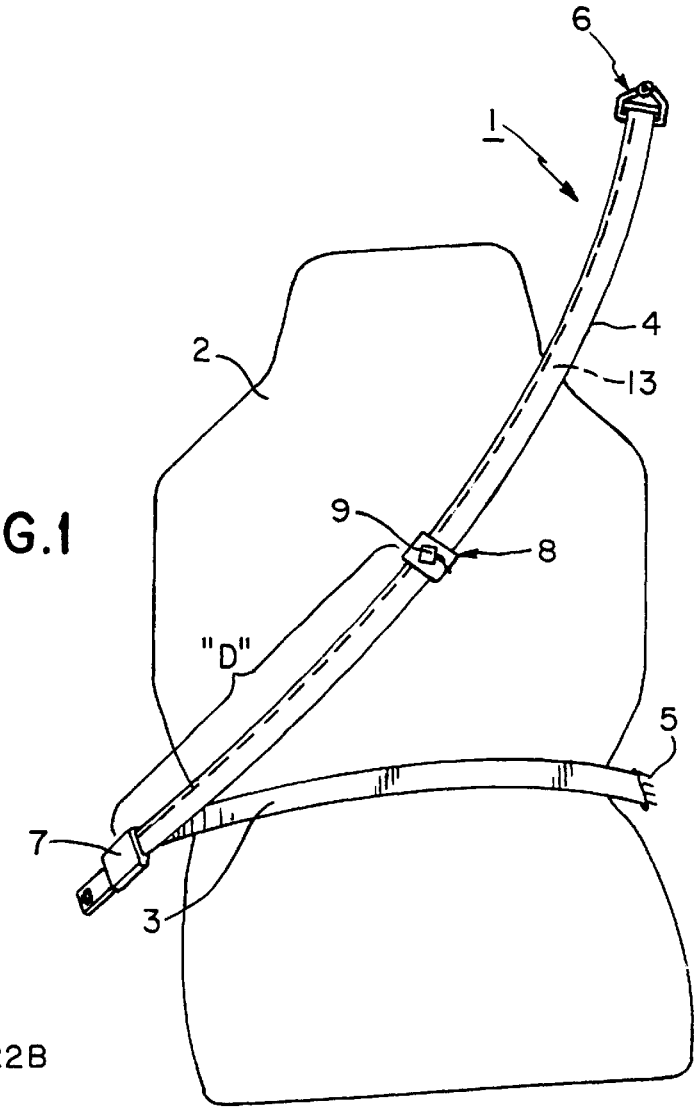
FIG. 1 is a schematic perspective illustration of the relationship of the seat and seatbelt illustrating the relationship of the parts to a microphone location.

Referring to FIG. 1 there is shown a schematic perspective illustration of the relations of the seat and seatbelt illustrating the relationship of the parts to the microphone locating capability of the invention. In FIG. 1 the seatbelt 1 for the seat 2 is made up of a lap belt 3 and a diagonal belt 4. The lap belt is attached at the outside end 5 to a retractor, not shown, passes over the lap of a person, also not shown, sitting in the seat 2, and ends in a buckle that can be inserted into a seatbelt buckle receptor, not shown, that is anchored to the vehicle. The diagonal belt 4 passes from a retractor, not shown, over a hanger 6, diagonally over the shoulder of and across the torso the person in the seat 2, to a end in a buckle that can be inserted into a seatbelt buckle receptor, not shown, that is anchored to the vehicle. Many seatbelt constructions use a common buckle, such as is illustrated as element 7, for both the lap 3 and diagonal 4 belts, in which case a single retractor is used as described for the diagonal belt. There are also some constructions where at the lower part of the diagonal web there is a retractor and there is a buckle at the upper part near the shoulder of the wearer.

In accordance with the invention for superior vocal communication of the person in the seat 2 wearing the seatbelt 1 a microphone should be positioned facing up towards the head and in the vicinity of the sternum of the person wearing the seatbelt and the invention provides these conditions by slider 8 on which a microphone 9 is adjustably mounted facing up and the location of the microphone 9 over the sternum at a distance "D" from the buckle 7 or an anchor at the lower portion of the diagonal web,is established at each seatbelt deployment by the slider 8 seeking the lowest position on the diagonal web 4 that the tape 13 will permit, or by attachment of the slider 8 to a locator tethering tape, out of sight in this figure, that runs from the buckle 7 to the hanger 6 and is attached at dimension "D" to the slider 8.

It will further be apparent that on the seatbelt type constructions where the lower part of the diagonal web is a retractor or anchor and a buckle is placed at the hanger the directions are reversed but the principle of positioning the slider and microphone over the sternum remains the same.

The microphone locating capability of the invention, once dimension "D" is established, requires no additional action on the part of the wearer and returns the microphone to the identical location at each deployment.

Figure 2:
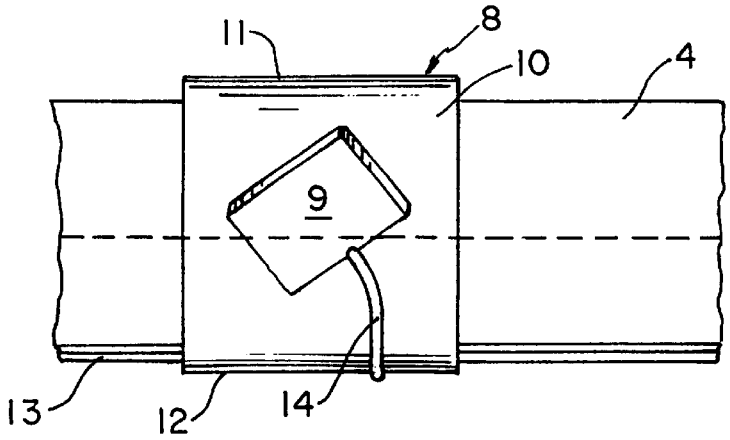
FIG. 2 is a schematic perspective illustration of the microphone bearing face of the slider member positioned on the diagonal seatbelt.

Referring to FIG. 2 where there is shown a schematic perspective illustration of the microphone 9 bearing face 10 of the slider 8 positioned on the diagonal belt 4. The slider 8 has fold around portions not visible in this figure on edges 11 and 12 that partially surround the diagonal belt 4 while permitting the slider 8 to move along it. The diagonal belt 4 has a tether such as a tape 13 that runs along the reverse side and is shown dotted in this figure. The conductor 14 for the microphone 9 passes around the edge 12 to the reverse side of the slider 8.

Figure 3:
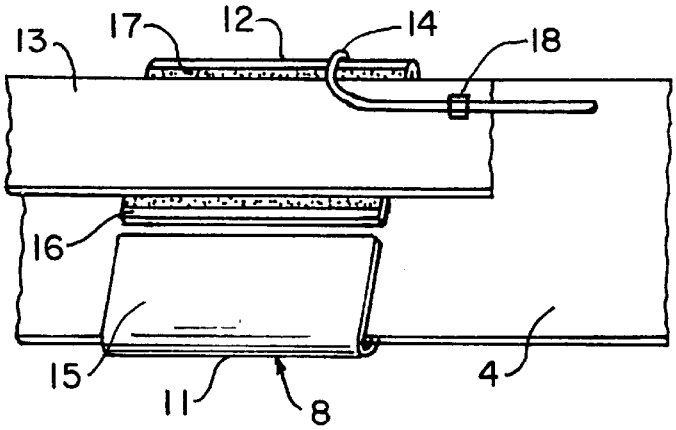
FIG. 3 is a schematic perspective illustration of a reverse side view of the slider member on the diagonal seatbelt illustrating the fastening to the narrower location establishing strap and the microphone wire location.

Referring to FIG. 3 where there is shown a schematic perspective illustration of the second and reverse side of the slider 8 positioned on the diagonal belt 4 with the fold over portions 15 and 16 from edges 11 and 12 respectively that hold the diagonal belt 4 but permit movement. The locating tether 13 runs from the buckle 7 to the hanger 6, neither visible in this figure, but the tape 13 is shown dotted in FIG. 1 and both the buckle 7 and the hanger 6 are shown in that figure. The tethering or tape attachment establishes the dimension "D" in FIG. 1 which is the distance from the buckle 7 to the microphone 9 location on the slider 8 at the sternum of the person in the seat 2. The locating tape 13 is attached to the fold around portion 16 of the slider 8 by a localized adjustable retaining region such as a hook and loop material area such as velcro(TM) labelled 17 on the slider portion 16 under the tape 13. When a person first uses the invention the slider 8 is positioned over the sternum and the slider 8 is attached at that position to the tethering tape 13. The microphone wire 14 is fastened by a retainer such as a clip 18 and is aligned with the travel of the slider 8.

Figure 5:
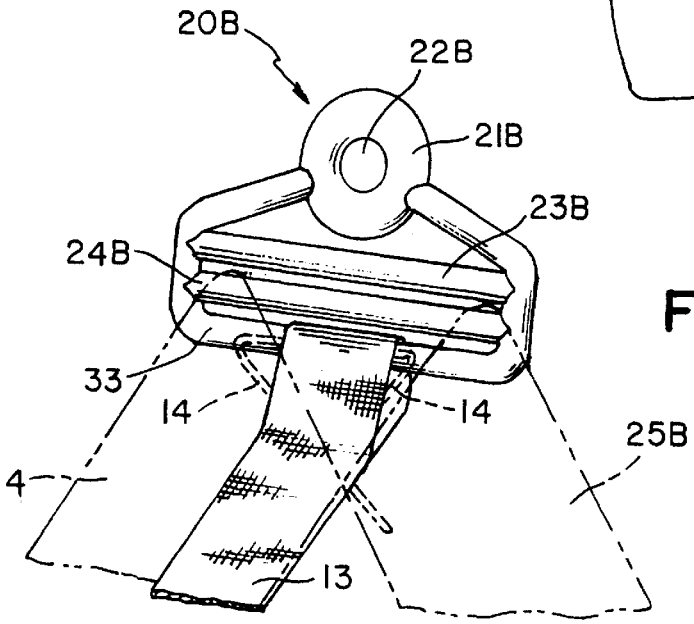
FIG. 5 is a schematic perspective illustration of a two crossbar retention hanger showing the narrower location establishing strap attachment.
Figure 4:
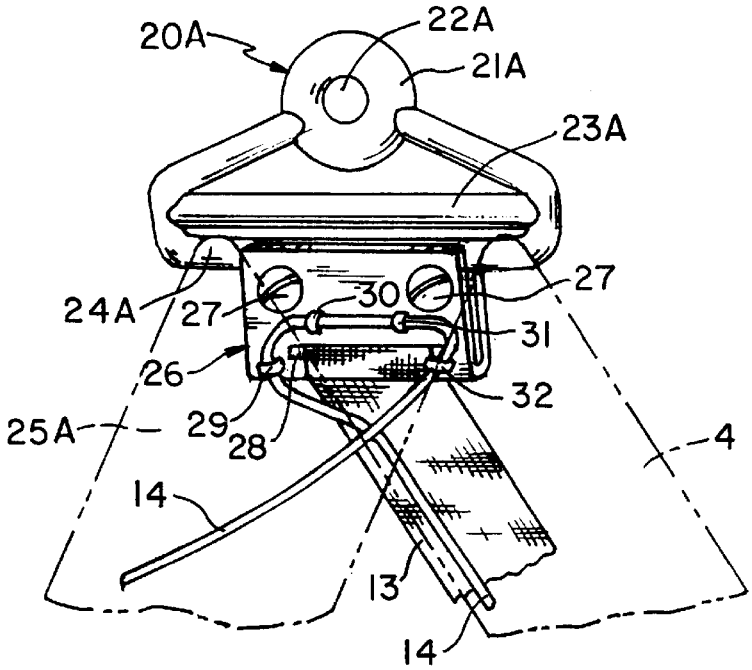
FIG. 4 is a schematic perspective illustration of a single crossbar seatbelt retention hanger illustrating the narrower location establishing strap attachment to the lower hanger crossbar and the microphone wire positioning.

In FIGS. 4 and 5 the hanger 6 of FIG. 1 is illustrated in two embodiments. The hanger 6 is the member in the system that is the upper locating member for the diagonal belt 4. It is located generally , when the seatbelt is deployed, somewhat above and behind the head of the person in the seat 2. When the seatbelt is retracted the hanger supports the slider 8, the buckle 7 and the diagonal belt 4 in the storage position. The location at which the hanger 6 is mounted when the seatbelt is retracted, in some vehicles is on the vertical member behind the door next to the person using the seatbelt; in other vehicles it travels on a track over the door to the front of the door at each retraction and in still other vehicles it may be mounted on a member associated with the seat.

Referring to FIG. 4 there is shown a schematic perspective illustration of a first hanger embodiment, a single crossbar seatbelt hanger 20A corresponding to the hanger 6 of FIG. 1. The hanger has a portion 21A with a hole 22A for attachment to a support member not shown that would be part of the vehicle. The hanger 20A has a crossbar 23A for rigidity and a lower crossbar 24A over which the seatbelt web passes. The seatbelt web is shown in dotted outline with the web segment with the locating tape 13 and the microphone wire 14 being the diagonal belt 4 and the web segment labelled 25A having passed over the hanger crossbar 24A, is attached to the seat belt retraction mechanism, not shown. A locating tape 13 and microphone wire attaching unit 26, is retained on the lower crossbar 24 A with fasteners 27 such as screws or rivets. The attaching unit 26 has a slot 28 through which the locating tape 13 passes and is secured by a clamping capability, not shown, or through the use of a hook and loop material such as velcro(TM) on a localized area on the back of the tape 13. The microphone wire 14 is passed through clips 29, 30, 31 and 32 which are positioned so that the microphone wire 14 comes to an end clip 29, passes through two in line clips 30 and 31 and is retained by the clip 32 at the other end so that the microphone wire has a loop at the intersection that prevents wear.

Referring to FIG. 5 where there is shown a schematic perspective illustration of second hangar embodiment, a two crossbar seatbelt hanger 20 B corresponding to the hanger 6 of FIG. 1. The hanger has a portion 21B with a hole 22B for attachment to a support member not shown that would be part of the vehicle. The hanger 20B has a crossbar 23 B for rigidity, a center crossbar 24B over which the seatbelt web passes. The seatbelt web is shown in dotted outline with the web segment with the locating tape 13 and the microphone wire 14 being the diagonal belt 4 and the web segment labelled 25B having passed over the hanger crossbar 24B. The microphone wire loop as described in connection with the first embodiment involving FIG. 4. is mostly out of sight in this view with the clips being attached to the lower crossbar 33. The locating tape 13, loops around the lower crossbar and is attached to itself using a hook and loop material such as velcro(TM).

Referring to FIG. 6 where there is shown a schematic perspective illustration of the invention in the retracted position. In FIG. 6 together with the other figures and assuming the embodiment of FIG. 5, the retraction mechanism has pulled the portion of the diagonal belt 4 between the hanger 6 and the slider 8 over the crossbar 24B. The travel stops at the condition where the slider 8 with the microphone 9 on it has been pulled to where it is as shown when the slider 8 is at hanger 20B. At this point the tape 13 hangs in two superimposed loops 34 and 35 with the loop 34 being the one involving the distance "D", that extends from the slider 8 to the buckle 7 and the loop 35 being the one involving the distance from the location of the slider 8 to the hanger crossbar 33 where the tape 13 is attached. The seat belt in the stored condition then occupies only the space of the slider 8, the buckle 7 and about half the distance "D" between the slider 8 and the buckle 7 or the distance between the slider 8 when in position over the sternum of the wearer and the hanger 20B; all in a vertical line under the hanger 20B.

Referring to FIG. 7 where there is shown a schematic perspective illustration of an alternative embodiment of the invention to that of FIG. 6. In FIG. 7 instead of the tape 13 and web 4 forming loops as indicated in FIG. 6 as elements 34 and 35 there are in FIG. 7 torsional spring windup devices that are well known in the art and which can be used in this application as elements 36 and 37.

Figure 8:
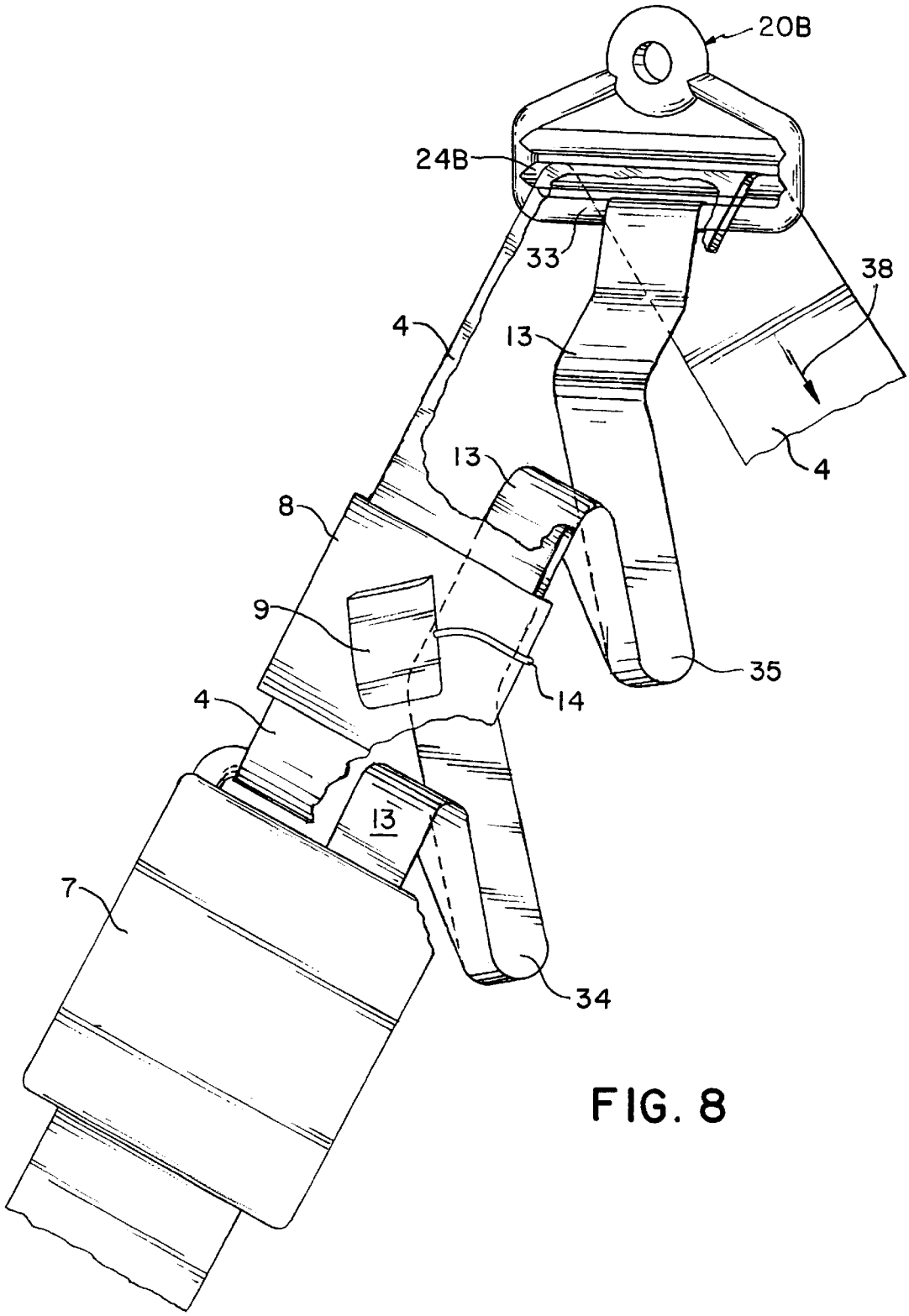
FIG. 8 is a schematic perspective illustration of the relation of the parts of the invention as the diagonal seatbelt approaches the retracted position.

Referring to FIG. 8 there is shown a schematic perspective illustration of the relation of the parts of the invention, using as an example the hanger structure of FIG. 5, as the diagonal seatbelt approaches the retracted position. In FIG. 8 the same reference numerals as used in the other figures are used. In retraction, the retractor, not shown, pulls the diagonal belt 4 over the crossbar 24B in the direction of the retractor as indicated by the arrow 38. As the diagonal belt 4 pulls the buckle 7 into contact with the slider 8 and then close to the hanger 20B as shown in FIG. 6 the two portions of the tape 13, each hang straight down as superimposed loops 34 and 35 the general directions of which are indicated in this figure as dotted in the broken away portions of the diagonal belt 4.

What has been described is a seatbelt that repeatedly positions a microphone at a precise location on a wearer through cycles of deployment and storage with no action on the part of the wearer being required.

What is claimed is:

1. In a vehicle seatbelt of the type that has a deployment and retraction cycle at each use, and that has at least a portion extending from a seatbelt hanger that is positioned in the vicinity of the shoulder of the person wearing said seatbelt extending diagonally and across the sternum in the torso of said person and ending at a location at the edge of the lap of said person, the microphone positioning improvement for repeated precise positioning of a voice communication microphone for said person wearing said seatbelt, comprising, providing a microphone bearing slider member, said slider member being positioned on and being adapted for slidable travel along said diagonal portion of said seatbelt, and providing a distance defining tether capability between said slider member and at least one location on said diagonal portion of said seatbelt whereby said slider member returns to the same position along said diagonal portion of said seatbelt each time said seatbelt is deployed.

2. The microphone positioning improvement of claim 1 wherein said tether capability is a tether member extending along said diagonal portion of said seatbelt from said hanger to a buckle at said lap location.

3. The microphone positioning improvement of claim 2 wherein said tether capability is a tape that defines the distance from said buckle to said sternum of said person wearing said seatbelt.

4. The microphone positioning improvement of claim 1 wherein said slider member has first and second faces and said microphone being mounted on said first face of said slider, said first face facing away from said person wearing said seatbelt, and said microphone being aimed at the head of said person wearing said seatbelt.

5. The microphone positioning improvement of claim 1 wherein said tether member is a tape that is parallel to said diagonal portion of said seatbelt.

6. The microphone positioning improvement of claim 1 wherein said attachment capability is moveable along said tether member.

7. The microphone positioning improvement of claim 6 wherein said hanger has separate means for attachment of said tether member to said hanger.

8. The microphone positioning improvement of claim 7 wherein said separate tether attachment means is an additional crossbar on said hanger.

9. The microphone positioning improvement of claim 7 wherein said separate tether attachment means is a holder attached to the lower crossbar of said hanger.

10. The microphone positioning improvement of claim 1 wherein said microphone is directionally focusable.

11. The microphone positioning improvement of claim 7 wherein the wire to said microphone passes around the edge of said slider and is clipped to said second face of said slider in alignment with travel along said diagonal portion of said seatbelt.

12. The microphone positioning improvement of claim 7 wherein said wire to said microphone is retained in a loop as it passes from said alignment with travel along said diagonal portion of said seatbelt at the attachment means for said tether at said hanger to the direction of the voice communication processor.

13. In a vehicle, an over the shoulder of a person type seatbelt, an improvement that returns a voice communication microphone to the same specific location at each deployment, said improvement comprising a a slider member having first and second faces, said slider member being slidably attached to said over the shoulder type seatbelt a microphone mounted on said first face of said slider, said first face facing away from said person, said microphone being aimed at the head of said person, a tether member extending along said over the shoulder type seatbelt including said specific location, said tether member being attached to said second face of said slider member at a location that defines the specific location at deployment.

14. The improvement of claim 13 wherein said specific location is over the sternum of a person wearing said over the shoulder seatbelt.

15. the improvement of claim 14 including means for retaining a wire from said microphone to a processor along said over the shoulder seatbelt and in a loop as it passes an intersection from said seatbelt.

* * * * *